US009771825B2

(12) United States Patent
Yoshida et al.

(10) Patent No.: US 9,771,825 B2
(45) Date of Patent: Sep. 26, 2017

(54) ACTIVATION CONTROL DEVICE

(71) Applicant: MITSUBISHI HITACHI POWER SYSTEMS, LTD., Kanagawa (JP)

(72) Inventors: Yasuhiro Yoshida, Tokyo (JP); Takuya Yoshida, Tokyo (JP); Tatsuro Yashiki, Tokyo (JP); Yukinori Katagiri, Tokyo (JP); Eunkyeong Kim, Tokyo (JP); Kenichiro Nomura, Yokohama (JP); Kazunori Yamanaka, Yokohama (JP); Fumiyuki Suzuki, Yokohama (JP); Norihiro Iyanaga, Yokohama (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 226 days.

(21) Appl. No.: 14/531,293

(22) Filed: Nov. 3, 2014

(65) Prior Publication Data

US 2015/0121874 A1 May 7, 2015

(30) Foreign Application Priority Data

Nov. 7, 2013 (JP) ..... 2013-231117

(51) Int. Cl.
*F01K 13/02* (2006.01)
*F01D 19/02* (2006.01)
(Continued)

(52) U.S. Cl.
CPC ..... *F01D 19/02* (2013.01); *F01K 7/165* (2013.01); *F01K 13/02* (2013.01); *F22B 35/00* (2013.01);
(Continued)

(58) Field of Classification Search
CPC .... F01D 19/02; F01K 13/02; F05D 2260/821; F05D 2270/44
See application file for complete search history.

(56) References Cited

U.S. PATENT DOCUMENTS 4,841,918 A 6/1989 Fukayama et al.
4,888,953 A 12/1989 Fukayama et al.
(Continued)

FOREIGN PATENT DOCUMENTS

JP 62-279207 A 12/1987
JP 2002-106305 A 4/2002
(Continued)

OTHER PUBLICATIONS

Shoji Hiraga, "Automatic Thermal Power Plant Starting Device", Hitachi Hyoron, 1966, pp. 763-767, vol. 48, No. 6
(Continued)

*Primary Examiner* — Jonathan Matthias
(74) *Attorney, Agent, or Firm* — Mattingly & Malur, PC

(57) ABSTRACT

Provided is a steam turbine plant activation control device that can flexibly handle an initial state amount of a steam turbine plant and activate a steam turbine at a high speed. The activation control device 21 for the steam turbine plant includes a heat source device 1 configured to heat a low-temperature fluid using a heat source medium and generate a high-temperature fluid, a steam generator 2 for generating steam by thermal exchange with the high-temperature fluid, a steam turbine 3 to be driven by the steam, and adjusters 11, 12, 13, 14, 15 configured to adjust operation amounts of the plant.

11 Claims, 8 Drawing Sheets

(51) Int. Cl.
*F01K 7/16* (2006.01)
*F22B 35/00* (2006.01)

(52) U.S. Cl.
CPC .... *F05D 2260/821* (2013.01); *F05D 2270/44* (2013.01)

(56) References Cited

U.S. PATENT DOCUMENTS

| | | | |
|---|---|---|---|
| 7,980,053 | B2 | 7/2011 | Yakushi et al. |
| 8,240,148 | B2 | 8/2012 | Matsumoto et al. |
| 2009/0288416 | A1 | 11/2009 | Matsumoto et al. |
| 2011/0071692 | A1 | 3/2011 | D'Amato et al. |

FOREIGN PATENT DOCUMENTS

| | | | |
|---|---|---|---|
| JP | 4208397 | B2 | 10/2008 |
| JP | 2009-281248 | A | 12/2009 |
| JP | 2010-121598 | A | 6/2010 |
| JP | 4723884 | A | 4/2011 |
| JP | 2011-111959 | A | 6/2011 |
| JP | 4885199 | B2 | 12/2011 |

OTHER PUBLICATIONS

L. Balling, "Fast cycling and rapid start-up: new generation of plants achieves impressive results", Modern Power Systems, Jan. 2010, pp. 35-41.

C. Ruchti et al., "Combined Cycle Power Plants as ideal solution to balance grid fluctuations", Kraftwerkstechnisches Kolloquium TU Dresden, Sep. 18-19, 2011.

Shigeru Matsumoto et al., "Optimum Turbine Startup Methodology Based on Thermal Stress Prediction", Sep. 2010, pp. 798-803, vol. 61, No. 9.

Extended European Search Report received in corresponding European Application No. 14191752.6 dated Apr. 10, 2015.

Japanese Office Action received in corresponding Japanese Application No. 2013-231117 dated Jul. 18, 2017.

ACTIVATION CONTROL DEVICE

BACKGROUND OF THE INVENTION

1. Field of the Invention

The present invention relates to an activation control device for a steam turbine plant.

2. Description of the Related Art

Renewable energy for power generation is typified by wind power generation and solar power generation. For a power plant using such renewable energy, the amount of electric power generated from renewable energy greatly varies depending on seasons, weather, and the like. Thus, this kind of power plant provided with a steam turbine needs to further reduce the time it takes for activation (or activate the power plant at a high speed) in order to suppress a variation in the power generation amount for stabilization of the power plant.

Upon the activation of the power plant, since the temperature and amount of steam flowing in the steam turbine rapidly increase, the temperature of a front surface of a turbine rotor rapidly increases, compared with the inside of the turbine rotor. As a result, stress (thermal stress) due to the difference between the surface of the turbine rotor and the inside of the turbine rotor increases. Since excessive thermal stress may reduce the life of the turbine rotor, it is necessary to suppress the increased thermal stress to a preset limit or lower. In addition, in the activation of the steam turbine, the turbine rotor and a casing storing the turbine rotor are exposed to high-temperature steam, thereby heated, and elongate (thermal elongation) by thermal expansion in a direction in which a turbine shaft extends. Since the turbine rotor and the casing are different from each other in the structure and in the heat capacity, the difference in the thermal elongation (thermal elongation difference) occurs between the turbine rotor and the casing. If the thermal elongation difference increases, the turbine rotor that is a rotary body and the casing that is a stationary body may contact each other and be damaged. It is, therefore, necessary to suppress the thermal elongation difference to a preset limit or less. Since there are some constraints for the activation of the steam turbine, it is necessary to control the activation while satisfying the constraints.

As an activation control method of this type, there is a method in which an activation mode is determined based on a time elapsed after the stop of a power plant, that is an elapsed time after the power plant is stopped, and the activation of the power plant is controlled based on an activation schedule determined for each of activation modes (refer to Non-Patent Document 1: "Shoji Hiraga: "Automatic Thermal Power Plant Starting Device", Hitachi Hyoron, Vol. 48, No. 6, 763-767 pp. (1966)" and the like). In addition, there is another method in which the activation of a gas turbine and the activation of a steam turbine are controlled based on a measured temperature of a casing metal arranged at a stage of the steam turbine in order to suppress the occurrence of thermal stress (refer to Japanese Patent No. 4208397 and the like). In addition, there is still another method in which activation patterns are switched among activation patterns such as a pattern prioritizing a time required for activation, a pattern prioritizing an efficiency, based on needs for activation (refer to Non-Patent Document 2: "L. Balling: Fast cycling and rapid start-up: new generation of plants achieves impressive results, Modern Power Systems, January (2010)", Japanese Patent No. 4885199, and the like). In addition, there is still another method in which an increase rate of the temperature of steam to be supplied to a steam turbine is defined and a plant is controlled based on the increase rate of the temperature (refer to Non-Patent Document 3: "C. Ruchti et al.: Combined Cycle Power Plants as ideal solution to balance grid fluctuations, Krafwerkstechnisches Kolloquium, T U Dresden, 18-19, September (2011)" and the like). In addition, there is still another method in which thermal stress and a thermal elongation difference for a certain time period from a current time to a future time are predicted and an activation schedule is obtained that enables a steam turbine to be activated at a high speed while suppressing the predicted thermal stress to a limit or lower (refer to Non-Patent Document 4: "Shigeru Matsumoto and other 2 people: Optimum Turbine Startup Methodology Based on Thermal Stress Predition, Vol. 61, No. 9 p. 798-803 (September, 2010)", Japanese Patent No. 4723884, JP-2009-281248-A, JP-2011-111959-A, and the like).

SUMMARY OF THE INVENTION

Non-Patent Document 1 exemplifies a method for controlling activation using four types of activation modes, cold start, warm start, hot start, and very hot start, based on a time period elapsed after the stop of a plant. For each of the activation modes, an increase rate of a rotation speed of a steam turbine, a time period (heat soak time period) in which the increase rate of the rotation speed of the steam turbine is maintained at a constant value, an initial load, a time period (load retention time period) in which a load is maintained at a constant value without a change, a change rate (load change rate) of a load per time, and the like are determined in advance. The activation is controlled in accordance with an activation schedule determined based on these values. As a result, the activation can be controlled while constraints for thermal stress and a thermal elongation difference are suppressed to limits or lower. The activation schedule, however, is determined in consideration of a variation in each of various state amounts and of a variation in each of various operation amounts of the steam turbine so that sufficient margin is set for the constraint. The metal temperature of the steam turbine upon the start of the activation varies depending on a time elapsed after the stop of the plant. Even in the same activation mode, when the time elapsed after the stop of the plant is short, the margins in the activation schedule are excessive and a time required for the activation is not sufficiently reduced.

JP-2011-111959-A discloses a method in which future thermal stress is calculated in predictive manner by a plant state prediction circuit, and a speed increase rate and load increase rate of a steam turbine are calculated so as to suppress the predicted thermal stress to a defined value or lower, thereby obtaining an activation schedule. In this method, a highly accurate and reliable operation amount can be calculated that are necessary for achieving a reduction in time required for activation. In JP-2011-111959-A, however, time trends are defined in advance for the pressure and temperature of steam to be supplied to the steam turbine, and how these state amounts are determined is not described.

In the other related-art documents, a technique for controlling the activation of a plant while suppressing thermal stress to a limit or lower is disclosed, but the techniques all require to use an activation schedule or a parameter based on an activation mode defined in advance. Specifically, since the plant is activated in accordance with a limited pattern only, it is hard to say that the methods control the activation at a high speed in the most efficient manner while flexibly handling a initial plant state amount such as a time elapsed after the stop of the plant, which varies every time the plant is activated.

The invention has been made under such circumstances, and it is an object of the invention to provide an activation control device for a steam turbine plant, which is configured to enable the steam turbine plant to be activated at a high speed while flexibly handling initial state amounts of the plant.

In order to accomplish the aforementioned object, an activation control method and an activation control device are provided, which activate a steam turbine at a high speed based on an initial state amount of a plant by predictively calculating a constraint related to the activation, such as a constraint for thermal stress and a constraint for thermal elongation difference, and comprehensively controlling the overall plant including a system for generating steam to be supplied to the steam turbine. For the activation control, a control parameter to be used to determine a requested operation amount of the plant based on a predicted value of the constraint and a activation control parameter value such as a control setting value related to an activation schedule are continuously calculated based on the initial state amounts of the plant, such as the temperature of a predetermined part of the steam turbine before the activation (initial metal temperature) and a time elapsed after the stop of the plant. Thus, a time required for the activation can be further reduced without depending on an activation mode.

According to the invention, the steam turbine can be activated at a high speed based on the various initial state amounts of the plant.

DESCRIPTION OF THE PREFERRED EMBODIMENTS

First Embodiment

Configuration

Figure 1:
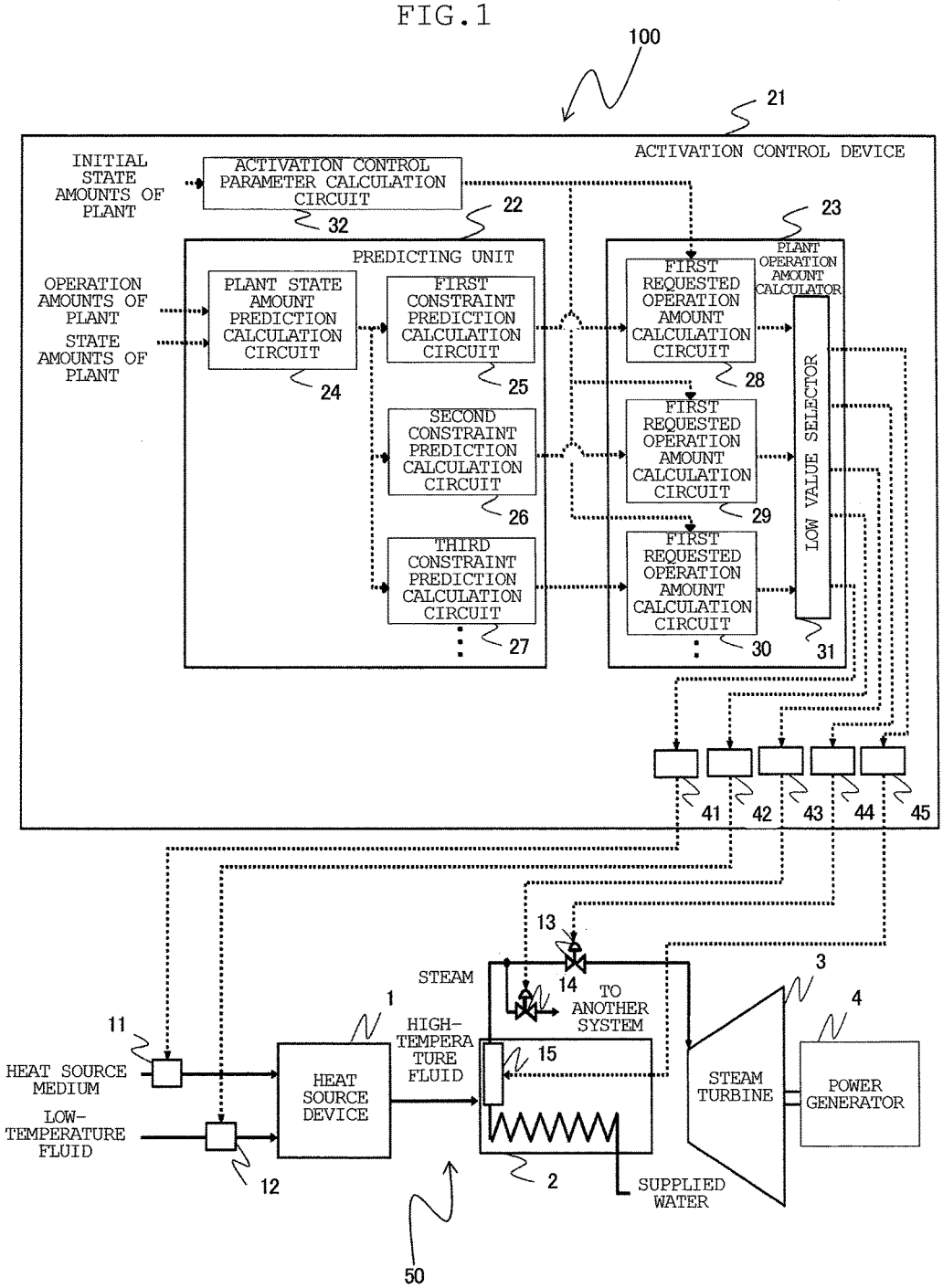
FIG. 1 is a schematic diagram illustrating a power plant according to a first embodiment of the invention.

FIG. 1 is a schematic diagram illustrating a power plant 100 according to a first embodiment. As illustrated in FIG. 1, the power plant 100 includes a steam turbine plant 50 and an activation control device 21. The steam turbine plant 50 and the activation control device 21 are described below.

1. Steam Turbine Plant

As illustrated in FIG. 1, the steam turbine plant 50 includes a heat source device 1, a steam generator 2, a steam turbine 3, a power generator 4, a heat source medium amount adjusting unit 11, a low-temperature fluid amount adjusting unit 12, a main steam adjusting valve 13, a bypass valve 14, and a desuperheater 15.

The heat source device 1 uses heat held by a heat source medium to heat a low-temperature fluid to generate a high-temperature fluid and supplies the high-temperature fluid to the steam generator 2. The steam generator 2 has a heat exchanger therein and heats supplied water by heat exchange with heat held by the high-temperature fluid generated by the heat source device 1 and generates steam. The steam turbine 3 is driven by the steam generated by the steam generator 2. The power generator 4 is coupled to the steam turbine 3 and converts driving force of the steam turbine 3 into power. The power generated by the power generator 4 is supplied to a power system (not illustrated), for example.

The heat source medium amount adjusting unit 11 is arranged on a path through which the heat source medium is supplied to the heat source device 1. The heat source medium amount adjusting unit 11 adjusts the amount of the heat source medium to be supplied to the heat source device 1 and adjusts the amount of heat held by the high-temperature fluid to be generated by the heat source device 1. The low-temperature fluid amount adjusting unit 12 is arranged on a path through which the low-temperature fluid is supplied to the heat source device 1. The low-temperature fluid adjusting unit 12 adjusts the flow rate of the low-temperature fluid to be supplied to the heat source device 1 and adjusts the flow rate of the high-temperature fluid to be supplied from the heat source device 1 to the steam generator 2. The main steam adjusting valve 13 is arranged in a steam pipe system that connects the steam generator 2 to the steam turbine 3 and draws the steam from the steam generator 2. The main steam adjusting valve 13 adjusts the flow rate of the steam to be supplied to the steam turbine 3. The bypass valve 14 is arranged in a bypass system that is branched from the steam pipe system of the steam generator 2 and discharges the steam flowing in the steam pipe system into another system. The bypass valve 14 controls the flow rate (bypass flow rate) of the steam flowing in the bypass system. The desuperheater 15 is arranged in the steam generator 2. The desuperheater 15 reduces the temperature of the steam generated by the steam generator 2. The heat source medium amount adjusting unit 11, the low-temperature fluid amount adjusting unit 12, the main steam adjusting valve 13, the bypass valve 14, and the desuperheater 15 function as adjusters for adjusting operation amounts (described later) of the plant.

The operation amount and the state amount of the power plant 100 are input to the activation control device 21. As the plant operation amount input to the activation control device 21, various measured values each represent the operation amounts adjusted by the aforementioned adjusters are used. An input value of the plant state amount input to the activation control device 21, which represents the plant state amount of the steam turbine plant 50, includes various measured values, which represent the state amounts of the temperature and pressure of a constituent element of the steam turbine plant 50, the state amounts of the temperature and pressure of the working medium, and the state amount of a flow rate of the working medium. In the present embodiment, measured values that represent the operation amounts of the heat source medium amount adjusting unit 11, low-temperature fluid amount adjusting unit 12, main steam adjusting valve 13, bypass valve 14, desuperheater 15, and the like are input each as the input value of the plant operation amount to the activation control device 21, while measured values that represent the plant state amounts, such as the temperature, pressure, and flow rate of the main steam and the temperature of metal of the steam turbine are input each as the input value of the state amount of the plant to the activation control device 21.

2. Activation Control Device

First, the activation control device 21 calculates, based on the aforementioned input operation amount of the plant and the aforementioned input state amount of the plant, a predicted value of at least one of the constraints (the predicted value of the constraint) to be used to control the activation of the steam turbine 3. The constraint include at least one of a constraint for thermal stress (hereinafter referred to as thermal stress of a turbine rotor) caused by the difference in temperature between a surface of the turbine rotor and an inside of the turbine rotor of the steam turbine 3 and a constraint for the difference in thermal elongation (hereinafter referred to as thermal elongation difference of the turbine rotor) between the turbine rotor of the steam turbine 3 and a casing storing the steam turbine 3. The constraint may include at least one of other constraints such as a constraint for thermal deformation of the casing (displacement of the casing in a radius direction or a circumferential direction) and a constraint for the difference in temperature between the inside and outside of the casing. Secondly, the activation control device 21 calculates an operation amount (a command value for the adjuster) of each of the adjusters based on the predicted value of the constraint. The activation control device 21 enables an effect (constraint) of a large time constant (delay of a response with respect to input) to be appropriately shifted by calculating the operation amount of the adjuster based on the predicted value of the constraint, compared with a case where an operation amount of a constituent element of an adjuster is calculated based on a current measured value, like feedback control, for example.

In order to achieve the aforementioned functions, the activation control device 21 includes a predicting unit 22, a plant operation amount calculator 23, an activation control parameter calculation circuit (activation control parameter setting unit) 32, and command value output circuits (that are a thermal source medium amount operational state calculation circuit 41, a low-temperature fluid amount operational state calculation circuit 42, a main steam adjusting valve operational state calculation circuit 43, a bypass valve operational state calculation circuit 44, and a desuperheater operational state calculation circuit 45). These constituent elements are sequentially described below.

2-1. Predicting Unit

The predicting unit 22 calculates, based on the aforementioned input operation amount of the plant and the aforementioned input state amount of the plant, a predicted value of at least one of the constraints to be used to control the activation of the steam turbine 3. The predicting unit 22 includes a plant state amount prediction calculation circuit 24, a first constraint prediction calculation circuit 25, a second constraint prediction calculation circuit 26, and a third constraint prediction calculation circuit 27.

2-1-1. Plant State Amount Prediction Calculation Circuit

An operation amount and a state amount of the plant that are measured by a detector (not illustrated) are input to the plant state amount prediction calculation circuit 24 as the input operation amount of the plant and the input state amount of the plant respectively. The plant state amount prediction calculation circuit 24 calculates, based on the input operation amount of the plant and the input state amount of the plant, a predicted future plant state amount for a set prediction time period. The prediction time period is set to a time period longer than the longest time period among prediction time periods that are first, second, third prediction time periods and the like and are individually set for each of the constraints.

As a method for calculating a predicted value for a constraint upon the activation of the plant, the following arbitrary known methods can be used: a model prediction control method of a known control engineering; a prediction method in which a future requirement for a plant operation is input for calculation to a known calculation model formula according to a physical phenomenon relating to a constraint, which is a thermodynamic, hydrodynamic, or heat transfer engineering calculation model formula; a method in which a future change rate of a plant operation amount is acquired by referencing a table of a process value such as a current metal temperature; a method in which a current change rate is extrapolated for a prediction time period, and the like.

The predicted state amount of the plant, which is calculated by the plant state amount prediction calculation circuit 24, is a physical amount representing thermal state of a part of the plant, which is necessary for estimating a value for the constraint. The physical amount includes: the pressure, flow rate, and temperature of the main steam at an inlet of the steam turbine; the pressure, flow rate, temperature, and heat transfer rate of the steam on the downstream side of an initial stage of the steam turbine; and the like. An arbitrary method based on a known natural science rule or known engineering may be used to calculate the physical amount. Examples of the method for calculating the physical amounts are described below.

Method for Calculating Requirement for Main Steam at Inlet of Steam Turbine (Procedure A1)

A process of transferring heat and a substance from the heat source device 1 through the steam generator 2 to supply to the steam turbine 3 is calculated from a known formula for energy balance or a formula for mass balance based on operation amounts of the heat source medium amount adjusting unit 11 and low-temperature fluid amount adjusting unit 12. The flow rate and temperature of the steam at the inlet of the steam turbine and enthalpy at the inlet of the steam turbine are calculated. Then, a rated pressure value is corrected to calculate the pressure using the flow rate and temperature of the steam at the inlet of the steam turbine based on a formula for calculation of an acoustic flow rate.

Method for Calculating Requirement for Steam at Initial Stage of Stage Turbine (Procedure A2)

The pressure of the steam on the downstream side of the initial stage of the steam turbine is obtained by subtracting pressure loss on the downstream side of the initial stage of the steam turbine from the pressure of the main steam at the inlet of the steam turbine. The pressure loss is calculated based on steam turbine design information specific to the plant. In addition, the flow rate of the steam on the downstream side of the initial stage of the steam turbine is obtained by adding or subtracting the flow rate of the steam flowing into another system to or from the flow rate of the main steam at the inlet of the steam turbine. The temperature of the steam on the downstream side of the initial stage of the steam turbine is calculated based on the pressure of the steam on the downstream side of the initial stage of the steam turbine and the enthalpy at the inlet of the steam turbine by referencing a calculation function (steam table) of steam characteristics. A rate of heat transfer between the steam on the downstream side of the initial stage of the steam turbine and the turbine rotor is calculated by a known formula for calculation of a heat transfer rate based on a flow rate obtained by combining the flow rate of the steam and the rotational speed of the turbine rotor and based on a kinematic viscosity coefficient. The kinematic viscosity coefficient is calculated from the pressure and temperature of the steam on the downstream side of the initial stage of the steam turbine by referencing the steam table.

2-1-2. Constraint Prediction Calculation Circuit

The first constraint prediction calculation circuit 25, the second constraint prediction calculation circuit 26, and the third constraint prediction calculation circuit 27 each calculate a predicted value for constraint for the set prediction time period, based on the predicted state amount of the plant, which has been calculated by the plant state amount prediction calculation circuit 24.

The prediction time period set for each of the first to third constraint prediction calculation circuits 25 to 27 is set corresponding to the constraint, that is, to the time period corresponding to conformability (response time) of a temporal change relative to a change of a state amount of the heat source medium, steam or the like. In the present embodiment, the prediction time periods set for the first to third constraint prediction calculation circuits 25 to 27 are referred to as the first prediction time period, the second prediction time period, and the third prediction time period respectively.

As described above, many constraints to be used to control the activation of the steam turbine 3 are due to differences in temperature in the inside of the structural body that is concerned with the activation of the steam turbine and to the metal temperature. Specifically, the constraint is almost due to the thermal stress of the turbine rotor, the thermal elongation difference of the turbine rotor, the thermal deformation of the casing, the difference in temperature between the inside and outside of the casing, or the like. The constraint to be used to control the activation of the steam turbine 3 is obtained by calculating heat transfer from the steam to the metal and calculating a distribution of temperature in the inside of the metal based on the result calculated in the aforementioned procedure A2. For example, the thermal stress of the turbine rotor is calculated based on a material engineering rule using a linear expansion coefficient, a Young's modulus, a Poisson ratio, and the like by calculating heat transfer from the steam to the turbine rotor and thereby calculating a temperature distribution in a radius direction of the turbine rotor. The thermal elongation difference of the turbine rotor is calculated based on a material engineering rule using a linear expansion coefficient by calculating, based on the calculation of heat transfer from the steam to the turbine rotor and the casing, the temperatures of parts included in the steam turbine and obtained by dividing the turbine rotor in a direction in which a turbine shaft extends. The thermal deformation of the casing is calculated based on a material engineering rule using a linear expansion coefficient, a Young's modulus, a Poisson ratio, and the like by calculating a temperature distribution in the inside of the casing based on the calculation of heat transfer from the steam to the casing and a shaft of the casing in a radius direction and a circumferential direction. The difference between the temperatures of the inside and outside of the casing is obtained by calculating heat transfer from the steam to the casing in an axis direction of the casing and in a radius direction of the casing and thereby calculating a temperature distribution in the radius direction of the casing.

Figure 2:
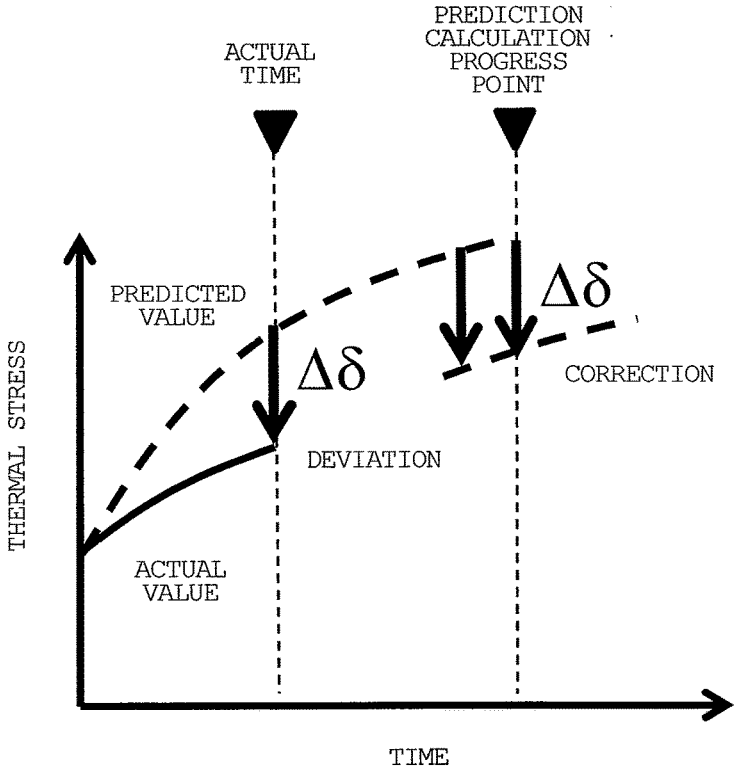
FIG. 2 is a diagram describing the concept of correction of predicted values for constraints, according to the first embodiment of the invention.
Figure 3:
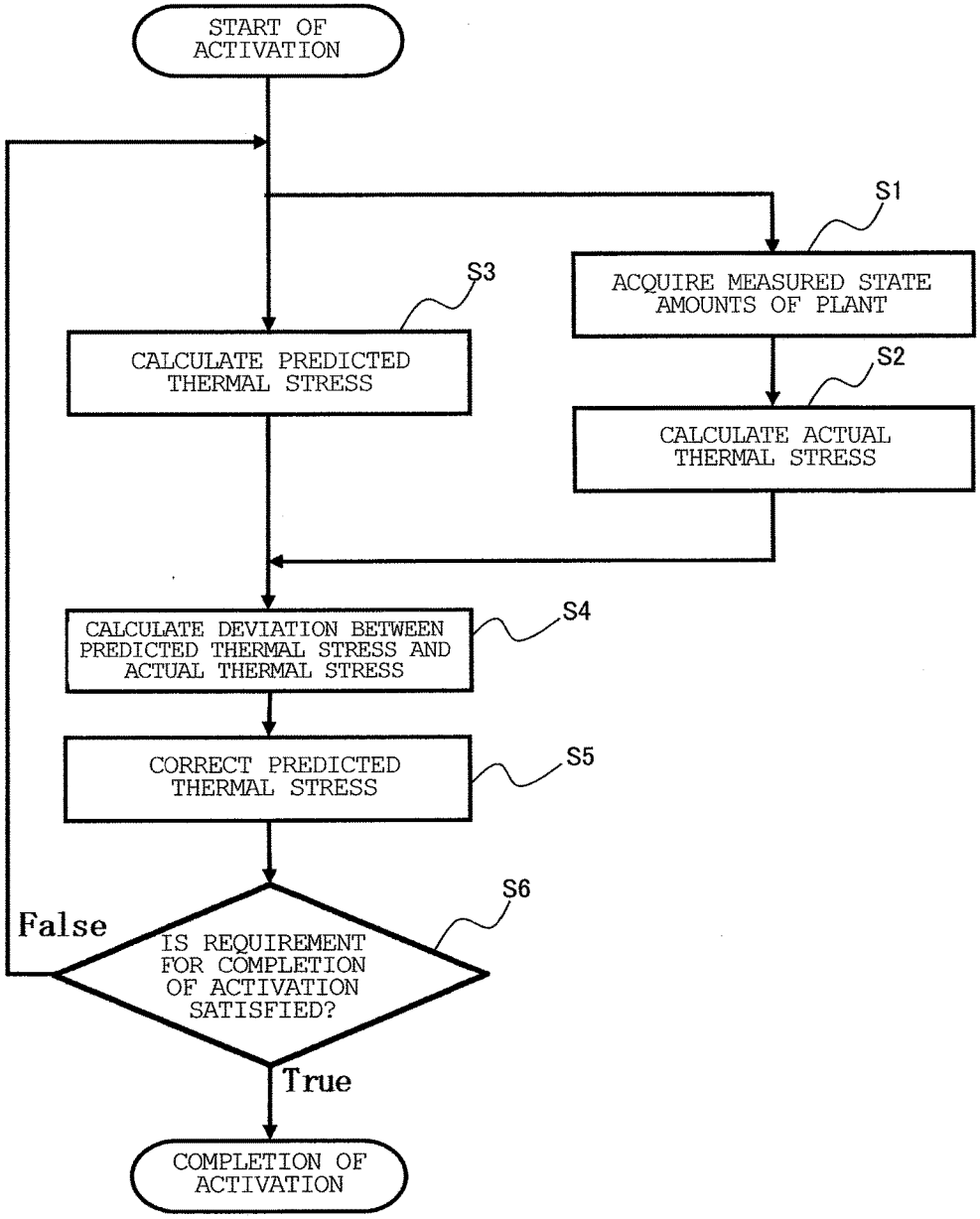
FIG. 3 is a flowchart of a procedure for correcting the predicted values for the constraints, according to the first embodiment of the invention.

In addition, each of the constraint prediction calculation circuits 25 to 27 corrects the predicted value for the constraint based on an actual state amount (including a measured value and a value calculated based on the measured value) of the plant. A procedure for correcting the predicted value for the constraint based on the actual amount is described below with reference to FIGS. 2 and 3. FIG. 2 is a diagram illustrating the concept of the correction of the predicted value for the constraint. In FIG. 2, an actual time indicates a current time, and a state in which calculation of the predicted value for the constraint for a time period to a time indicated by a prediction calculation progress point is progressed is illustrated. FIG. 3 is a flowchart of the procedure for correcting the predicted value for the constraint. The procedure for correcting the predicted value for the constraint based on the actual amount is described using the constraint for thermal stress of the turbine rotor as an example.

As illustrated in FIGS. 2 and 3, each of the constraint prediction calculation circuits 25 to 27 acquires, through the detector (not illustrated), measured state amount of the plant, such as a requirement for the steam for a time period to the actual time and the metal temperature (in S1). Each of the constraint prediction calculation circuits 25 to 27 calculates actual thermal stress based on the measured state amount of the plant (in S2). The constraint prediction calculation circuits 25 to 27 calculate predicted thermal stress of the turbine rotor for a time period to the time indicated by the prediction calculation progress point preceding the actual time (in S3). Next, the constraint prediction calculation circuits 25 to 27 each calculate a deviation Δ8 of the actual thermal stress of the turbine rotor from the predicted thermal stress at the actual time (in S4) and correct the predicted thermal stress of the turbine rotor, which is calculated after the actual time, so as to reduce the deviation Δ8 to the actual thermal stress of the turbine rotor (in S5). Then, the constraint prediction calculation circuits 25 to 27 each determine whether or not a requirement for the completion of the activation of the plant is satisfied, that is whether or not the activation of the plant has been completed (in S6). If the requirement for the completion of the activation of the plant is satisfied, the procedure is terminated. On the other hand, if the requirement for the completion of the activation of the plant is not satisfied, S1 to S5 are repeatedly performed. The procedure for correcting the predicted thermal stress based on the actual thermal stress of the turbine rotor is described with reference to FIGS. 2 and 3. However, a predicted value for another constraint for the thermal elongation difference of the turbine rotor, thermal deformation of the casing, and the difference in temperature between the inside and outside of the casing may be corrected. Alternatively, a predicted state amount of the plant, such as the temperature of the steam, the pressure of the steam, or the metal temperature of a predetermined member of the steam turbine may be corrected. In these cases, the correction methods are the same with each other. Although the case where the predicted thermal stress of the turbine rotor is corrected based on the actual thermal stress of the turbine rotor is described above, the predicted thermal stress of the turbine rotor may be corrected based on measured thermal stress of the turbine rotor.

2-2. Activation Control Parameter Calculation Circuit

The activation control parameter calculation circuit 32 calculates, based on an initial state amount of the plant, an activation control parameter to be used to control the activation of the steam turbine 3. The initial state amount of the plant is a state amount of the plant at an initial phase of the activation of the plant (or at the start time of the activation). For example, as the initial state amount, not only the state amount that enable the state of the plant to be directly evaluated based on a measured value, but also a state amount including a time elapsed after the stop, which enables the state of the plant to be indirectly evaluated may be used. The state amount that enable the state of the plant to be directly evaluated is, for example, the metal temperature at the initial activation (initial metal temperature) of the casing at the inlet of the steam turbine and the turbine rotor, the thermal stress or the thermal elongation of the turbine rotor, or the thermal elongation difference in the turbine rotor or difference in temperature between members of the steam turbine, such as the difference in temperature between the inside and outside of the casing. For example, if a state amount such as the temperature of the metal, which can be directly measured by a measurer are used, the initial state can be accurately estimated. On the other hand, if a state amount, which can be indirectly obtained, such as the thermal stress that is a value calculated based on measured values is used, it is not necessary to install a dedicated measurer for directly measuring the target state amount, and thus cost for equipment can be reduced.

Figure 4:
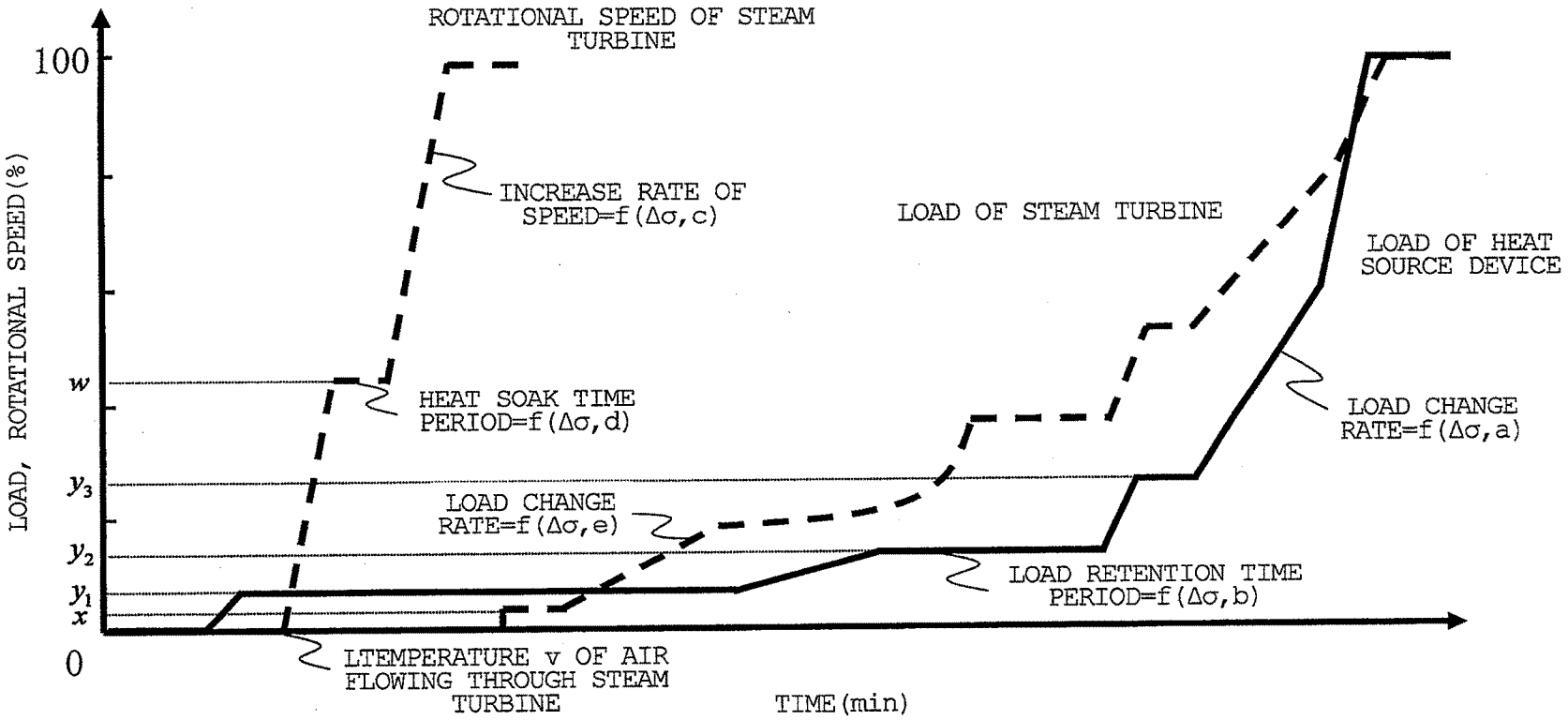
FIG. 4 is a diagram describing an example of an activation schedule, which describes activation control parameters calculated by an activation control parameter calculation circuit according to the first embodiment of the invention.

The activation control parameter includes a parameter to be used to determine requested operation amount (described later) of the plant based on the predicted value of the constraint and a control setting value related to an activation schedule. The activation control parameter is described with reference to FIG. 4. FIG. 4 is a diagram illustrating an example of the activation schedule and describing the activation control parameter calculated by the activation control parameter calculation circuit 32.

Examples of the activation control parameter are a parameter a of a function f(Δσ, a) for calculating a change rate (load change rate) of a load of the thermal source device per unit of time, a parameter b of a function f(Δσ, b) for calculating a time period (load retention time period) in which the load of the heat source device is maintained at a constant value without a change, a parameter c of a function f(Δσ, c) for calculating an increase rate of a rotational speed of the steam turbine, a parameter d of a function f(Δσ, d) for calculating a time period (heat soak time period) in which states such as the rotational speed and load of the steam turbine and the like is maintained at constant levels, a parameter e of a function f(Δσ, e) for calculating a change rate of a load of the steam turbine, based on the difference Δσ between a predicted value for a constraint and a limit for the constraint, and the like. The parameters a to e are coefficients or the like included in the functions f(Δσ, a), f(Δσ, b), f(Δσ, c), f(Δσ, d), and f(Δσ, e). The functions f(Δσ, a), f(Δσ, b), f(Δσ, c), f(Δσ, d), and f(Δσ, e) are prepared for each of the constraints. For example, the function f(Δσ, a) of the load change rate is prepared for each of the constraints, and the parameter a can be calculated from the function f(Δσ, a) for each of the constraints. The functions f(Δσ, a), f(Δσ, b), f(Δσ, c), f(Δσ, d), and f(Δσ, e) are stored in the activation control parameter calculation circuit 32. The activation control parameter calculation circuit 32 calculates the difference Δσ based on the input initial state amount of the plant and calculates a target activation control parameter from the interested function. The functions are each generated so that the closer the initial state amount of the plant is to the state in which the activation of the plant is completed, the more the activation control parameter reduce the time required for the activation. For example, regarding the temperature of the metal, the value of the parameter a is calculated so that as an initial value of the parameter a is higher, the change rate of the load of the heat source device 1 is higher, and the value of the parameter b is calculated so that as an initial value of the parameter b is higher, the load retention time period is shorter. The same applies to the parameters c, d, and e. Instead of the function, a function table of the initial state amount of the plant and the activation control parameter may be stored in the activation control parameter calculation circuit 32 and referenced, and activation control parameter that corresponds to the provided initial state amount of the plant may be determined. The control setting value related to the activation schedule are the temperature v of air flowing through the steam turbine, a rotational speed w during the heat soak time period, a load x during the heat soak time period, a load y applied to maintain the load of the heat source device, and the like. In the aforementioned example, the activation control parameters are variables a, b, . . . , v, respectively, but may be each a plurality of variables $a_1$, $a_2$, . . . , $b_1$, $b_2$, . . . , $v_1$, $v_2$, . . . .

2-3. Plant Operation Amount Calculator

The plant operation amount calculator 23 determines requested operation amounts of the plant based on the predicted value for the constraint, which is calculated by the predicting unit 22, and the activation control parameter calculated by the activation control parameter calculation circuit 32 so that the constraint does not exceed limit determined in advance. The plant operation amount calculator 23 includes a first requested operation amount calculation circuit 28, a second requested operation amount calculation circuit 29, a third requested operation amount calculation circuit 30, and a low value selector 31.

2-3-1. Requested Operation Amount Calculation Circuits

The first requested operation amount calculation circuit 28 calculates a requested operation amount of the plant for each command value output circuits 41 to 45 based on the predicted value for the constraint, which is calculated by the first constraint prediction calculation circuit 25, and the activation control parameter set by the activation control parameter calculation circuit 32 so that the constraint does not exceed the set limit. Values input to the first requested operation amount calculation circuit 28 from the first constraint prediction calculation circuit 25 and the activation control parameter calculation circuit 32 are values calculated for corresponding constraints (for example, thermal stress). Specifically, a value input from the first constraint prediction calculation circuit 25 is, for example, predicted thermal stress, and a value input from the activation control parameter calculation circuit 32 is, for example, the parameter using the difference Δσ between the limit for the thermal stress and the predicted thermal stress as a variable or the activation control parameter (parameter a in this case) calculated from the function of the load change rate. Similarly to the first requested operation amount calculation circuit 28, the second requested operation amount calculation circuit 29 and the third requested operation amount calculation circuit 30 each calculate requested operation amount of the plant for each of the command output circuits 41 to 45 based on the predicted value for the constraint, which is calculated by the second and third constraint prediction calculation circuits 26 and 27, and the activation control parameter calculated for the corresponding constraint by the activation control parameter calculation circuit 32 so that the corresponding constraints does not exceed the limit. The requested operation amounts of the plant are each calculated so that the values do not exceed the limits in accordance with the aforementioned functions. Thus, the requested operation amounts are an increase rate of the rotational speed of the steam turbine, the heat soak time period, the load change rate, the change rate of the load of the heat source device, the load retention time period of the heat source device, and the like. The requested operation amount calculation circuits 28 to 30 may each use a plurality of activation control parameters to calculate the requested operation amount of the plant. Specifically, the requested operation amount calculation circuits 28 to 30 may each calculate a plurality of requested operation amounts of the plant for each of the command value output circuits 41 to 45. The requested operation amount of the plant is calculated so that if the difference $\Delta\sigma$ is large, change rate of the operation amount of the plant is high and if the difference $\Delta\sigma$ is small, the change rate of the operation amount of the plant is low.

2-3-2. Low Value Selector

The low value selector 31 receives the requested operation amounts calculated by each of the requested operation amount calculation circuits 28 to 30, which are corresponding to each of the command value output circuits 41 to 45, selects the minimum value from among the requested operation amounts of the plant for each of the command value output circuits 41 to 45, and outputs each of the selected requested operation amounts to the command value output circuits 41 to 45 respectively.

2-4. Command Value Output Circuit

The heat source medium amount operational state calculation circuit 41, the low-temperature fluid amount operational state calculation circuit 42, the main steam adjusting valve operational state calculation circuit 43, the bypass valve operational state calculation circuit 44, and the desuperheater operational state calculation circuit 45 each calculate, based on the requested operation amounts received from the low value selector 31, command values (operational state command values) of operation amounts of the plant for the heat source medium amount adjusting unit 11, the low-temperature fluid amount adjusting unit 12, the main steam adjusting valve 13, the bypass valve 14, and the desuperheater 15 respectively so that the requested operation amounts of the plant are satisfied. The heat source medium amount operational state calculation circuit 41, the low-temperature fluid amount operational state calculation circuit 42, the main steam adjusting valve operational state calculation circuit 43, the bypass valve operational state calculation circuit 44, and the desuperheater operational state calculation circuit 45 each output the calculated command values of the operation amounts of the plant to the heat source medium amount adjusting unit 11, the low-temperature fluid amount adjusting unit 12, the main steam adjusting valve 13, the bypass valve 14, and the desuperheater 15, respectively.

Effects

1. Increase in Speed of Activation of Steam Turbine

In the present embodiment, the activation control parameter is set based on the initial state amount of the plant, and the activation schedule for the heat source device 1, the steam turbine 3, and the like is adjusted by prediction control based on the activation control parameter. Specifically, the activation control device 21 according to the present embodiment can flexibly set the activation control parameter and the activation schedule based on the initial state amount of the plant. Thus, the steam turbine can be activated at a high speed based on the various initial state amounts of the plant.

Figure 5:
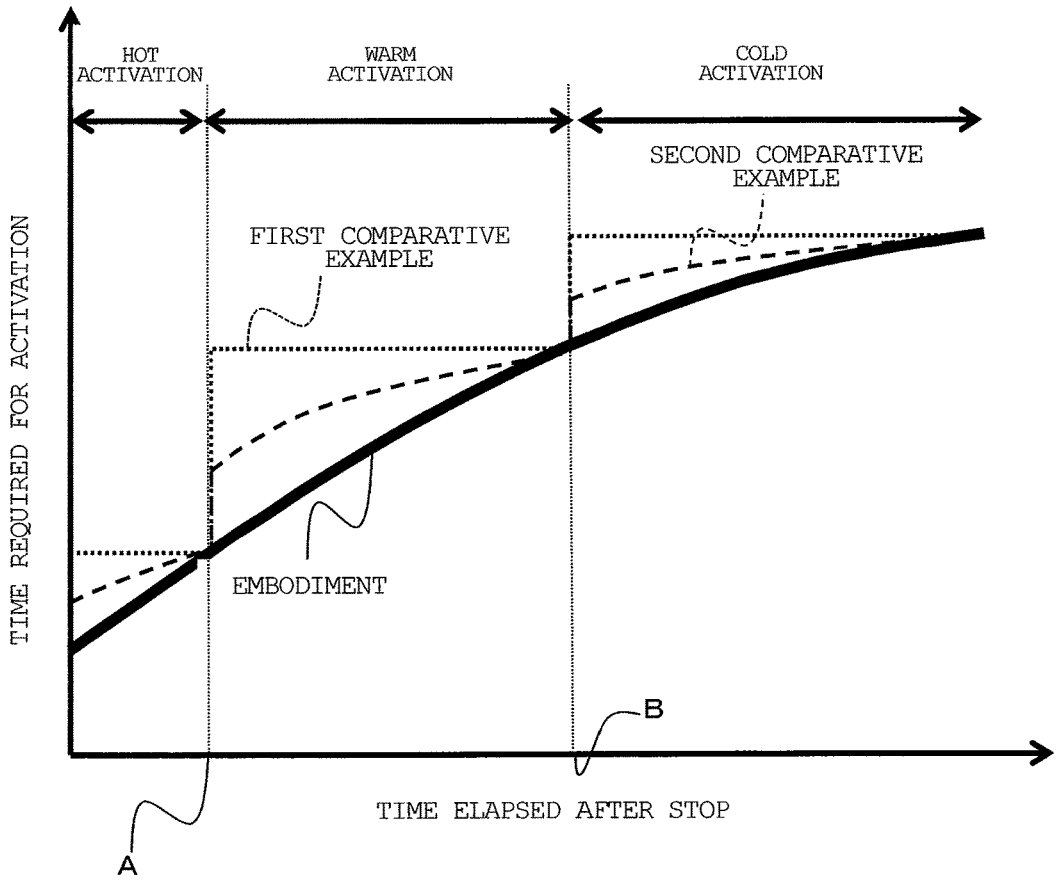
FIG. 5 is a diagram illustrating a relationship between a time elapsed after the stop of the power plant and a time required for the activation of the power plant in the activation schedule.

FIG. 5 is a diagram illustrating a relationship between a time elapsed after the stop of the power plant 100 and a time required for the activation in the activation schedule. The abscissa indicates the time elapsed after the stop, while the ordinate indicates the time required for the activation. An activation mode in which the activation is started at a time that is shorter than A is referred to as hot activation. An activation mode in which the activation is started at a time that is equal to or longer than A and shorter than B is referred to as warm activation. An activation mode in which the activation is started at a time that is equal to or longer than B is referred to as cold activation. The times A and B (A<B) are set values. In FIG. 5, a dotted line indicates a first comparative example in which an activation schedule and an activation control parameter depend on an activation mode. In the first comparative example, an activation mode is determined based on a time elapsed after the stop. In the same activation mode, a time required for the activation is set to a fixed value regardless of a time elapsed after the stop, and activation control parameters are determined for each of activation modes. In the same activation mode, the same activation schedule is used. A broken line indicates a second comparative example in which an activation schedule is adjusted by prediction control and activation control parameters depend on an activation mode. In the second comparative example, though the activation mode is determined depending on the time elapsed after the stop as is the case with the first comparative example, even in the same activation mode, an activation schedule is calculated, in which the shorter a time elapsed after the stop is, the shorter a time required for the activation is. This is an effect obtained by the prediction control. However, in the same activation mode, activation control parameter is set to fixed value regardless of a time elapsed after the stop, and a discontinuous point occurs at a boundary between the activation modes, which is due to a change of the activation control parameter. Thus, in each of the comparative examples, as a time elapsed after the stop is reduced in each of the activation modes, excessive margin occurs in the activation schedule.

On the other hand, a solid line indicates a case where the modeless activation described in the present embodiment is used. In the present embodiment, there is no concept of activation mode (modeless activation), and the activation control parameter is continuously changed based on the initial state amount of the plant, and a line that indicates the relationship between a time required for the activation and a time elapsed after the stop is not curved (or has no corner) and is a smoothly continuous line. In the present embodiment, an excessive margin for the constraint limit can be removed, the activation schedule that is highly appropriateness for reliability and safety for planning can be formed, and the plant can be safely activated at a high speed. Even if the abscissa in FIG. 5 indicates another initial state amount of the plant such that the initial metal temperature instead of the time elapsed after the stop, results that are the same as or similar to the results illustrated in FIG. 5 can be obtained.

In the present embodiment, each of the constraint prediction calculation circuits 25 to 27 corrects predicted thermal stress of the turbine rotor in accordance with the procedure of S1 to S6. Thus, the accuracy of prediction of the thermal stress of the turbine rotor is improved and the power plant can be safely activated. In addition, if a margin is provided for the constraint limit in consideration of an error of the predicted thermal stress of the turbine rotor, the margin can be reduced by improving the accuracy of the prediction, and the time required for the activation can be further reduced.

Second Embodiment

Figure 6:
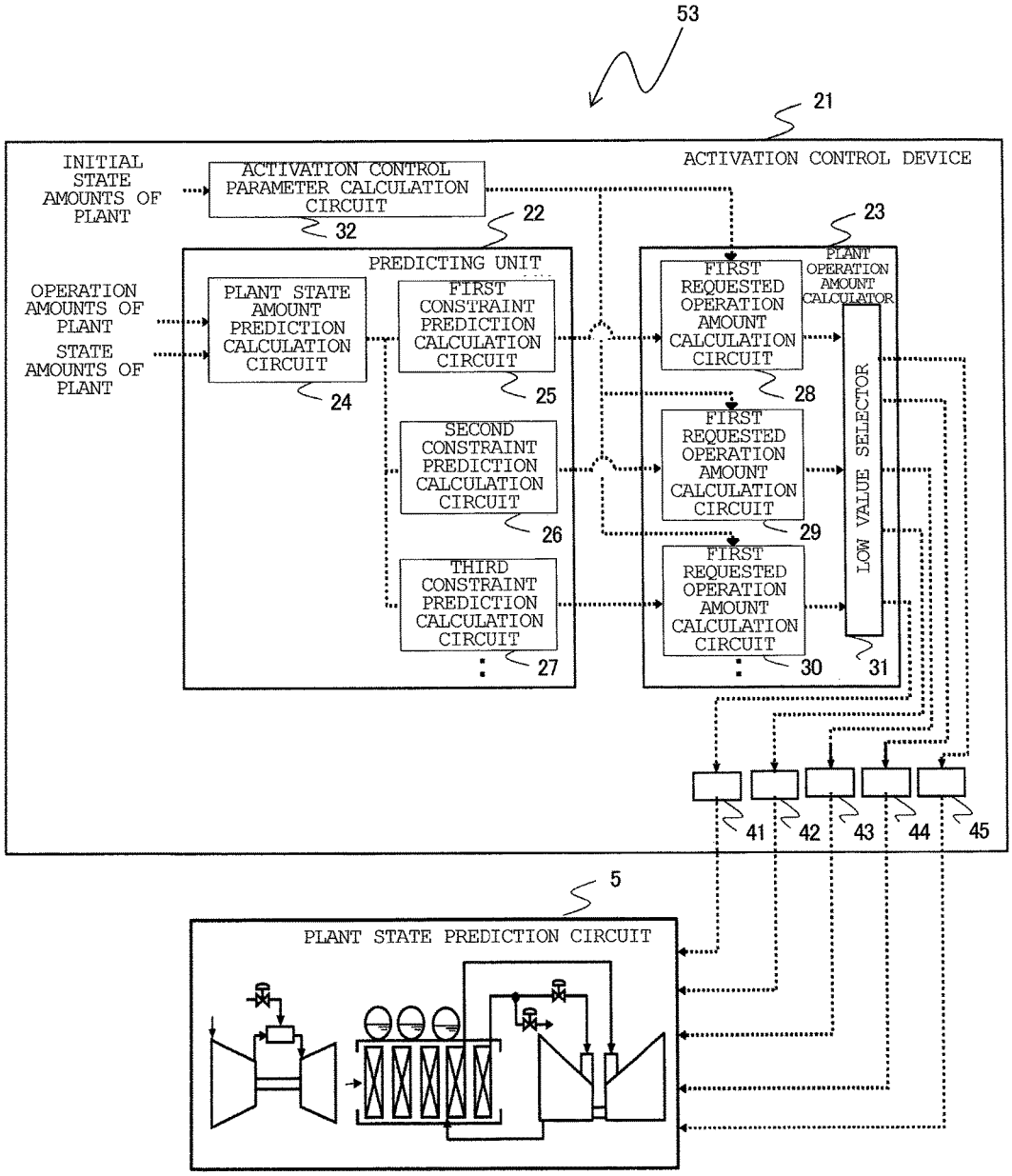
FIG. 6 is a schematic diagram illustrating a power plant according to a second embodiment of the invention.

FIG. 6 is a schematic diagram illustrating an activation schedule generation system 53 using the activation control device 21. Parts that are the same as or similar to those of the first embodiment are indicated by the same reference numerals as those of the first embodiment in FIG. 6, and a description thereof is omitted.

Configuration

The second embodiment is difference from the first embodiment in that a plant state prediction circuit 5 is provided instead of the steam turbine plant 50. Specifically, as illustrated in FIG. 6, the activation schedule generation system 53 includes the activation control device 21 and the plant state prediction circuit 5 that simulates characteristics of the steam turbine plant 50. The constituent elements are sequentially described below.

1. Plant State Prediction Circuit

The plant state prediction circuit 5 is a type of simulator and includes a plurality of calculators corresponding to constituent elements that are the heat source device, the steam generator, the steam turbine, and the like and form the steam turbine plant. The calculators are each formed by combining a pressure and flow rate calculation model for calculating the pressure and flow rates in the corresponding constituent elements from a known hydrodynamic formula, a temperature calculation model for calculating energy balance between the structural body of the plant and the working fluid from known thermodynamic and heat-transfer formulae, and the like.

Each of the constituent elements of the plant state prediction circuit 5 receives the command values of the operation amount of the plant, which are output from the command value output circuits (that are the heat source medium amount operational state calculation circuit 41, the low-temperature fluid amount operational state calculation circuit 42, the main steam adjusting valve operational state calculation circuit 43, the bypass valve operational state calculation circuit 44, and the desuperheater operational state calculation circuit 45) of the activation control device 21 and use the aforementioned calculation models to simulate and calculate an operation amount and an state amount of the plant. The command values of the operation amounts of the plant, which are received from the activation control device 21, are obtained by receiving arbitrary values as the initial state amounts of the plant, for example.

2. Activation Control Device

The activation control device 21 receives operation amounts and state amounts of the plant simulated and calculated by the plant state prediction circuit 5, calculates a predicted value of the constraint based on the operation amount and the state amount of the plant in the same manner as the first embodiment, and determines requested plant operation amount for each of the command value output circuits 41 to 45 based on the predicted value for the constraint and the activation control parameter. Although the activation control device 21 described in the second embodiment is the same as the activation control device 21 described in the first embodiment, the activation control device 21 may be connected to the steam turbine plant 50 or independent of the steam turbine plant 50.

The activation schedule generation system 53 gradually accumulates, in a storage unit (not illustrated), the operation amounts of the plant calculated in the aforementioned manner and the state amounts of the plant calculated in the aforementioned manner for a time period from the start of the activation of the plant to the completion of the activation of the plant and generates an planning activation schedule of the plant.

Effects

Since the activation schedule that is obtained in the first embodiment can be simulated by the aforementioned configuration in the second embodiment, the planning activation schedule of the plant can be generated in advance and the plant can be activated based on the planning activation schedule. Thus, the effects described in the first embodiment and the following effects can be obtained. That is, an operator can receive information such as a time when the plant is connected to the power system and a completion time of the activation, and it is possible to efficiently adjust planning of the activation of the plant and the power system.

Third Embodiment

An activation plan generation support system 60 according to a third embodiment is an example of the application of the activation schedule generation system 53 that is configured to generate an activation plan about how the plant activate when information about a time at which the plant is previously stopped and information about a target time when the activation of the plant is next completed are provided to the activation plan generation support system 60 in order to generate an actual plant activation time schedule.

Figure 7:
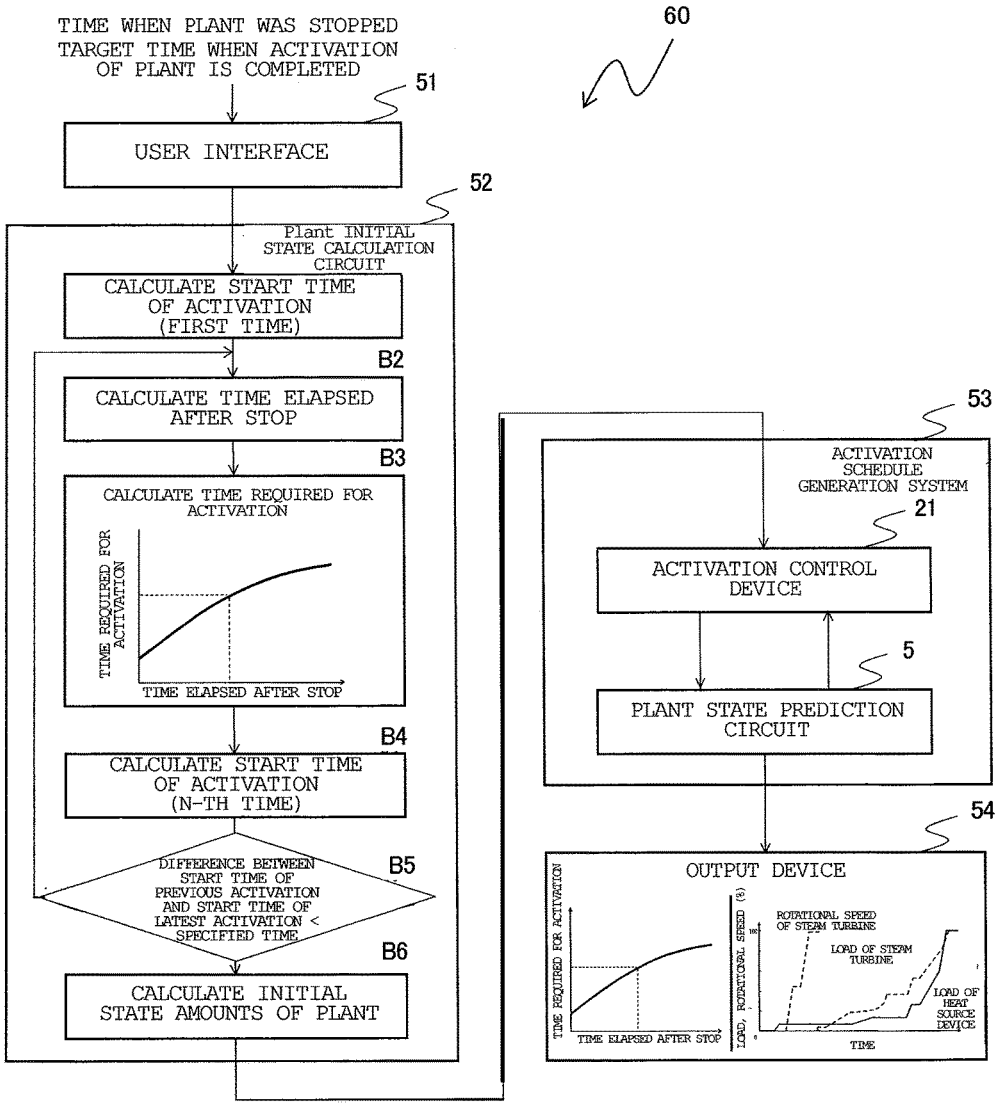
FIG. 7 is a diagram illustrating a configuration of a system according to a third embodiment of the invention and the flow of calculation in the system, which illustrates a procedure for the calculation up to the acquisition of an activation schedule by an operator.

FIG. 7 is a diagram illustrating a configuration of the activation plan generation support system 60 using the activation schedule generation system 53 and a calculation procedure performed in the activation plan generation support system 60. Parts that are the same as or similar to those of the second embodiment are indicated by the same reference numerals as those of the second embodiment in FIG. 7, and a description thereof is omitted.

Configuration

As illustrated in FIG. 7, the activation plan generation support system 60 includes a user interface 51, an initial plant state calculation circuit 52, the activation schedule generation system 53, and an output device 54. The constituent elements are sequentially described below.

1. User Interface

The time when the plant is previously stopped and the target time when the activation of the plant is next completed are input to the user interface 51. The input information is entered by the operator and output through the user interface 51 to the plant initial state calculation circuit 52.

2. Plant Initial State Calculation Circuit

The plant initial state calculation circuit 52 calculates an initial state amount of the plant based on the information input through the user interface 51. A procedure for calculating the initial state amount of the plant by the plant initial state calculation circuit 52 is described with reference to FIG. 7.

Procedure B1

First, the plant initial state calculation circuit 52 calculates an initial start time of the activation. As a method for the calculation, a current time or the input target time when the activation of the plant is next completed is used as the initial start time. The calculated initial start time of the activation is accumulated as the start time of the activation in a storage region (not illustrated) included in the plant initial state calculation circuit (activation start time calculation circuit) 52. The initial start time is calculated in the aforementioned manner, and a start time of the activation is repeatedly calculated and sequentially updated by the following procedures.

Procedure B2

Subsequently, the plant initial state calculation circuit 52 calculates a time elapsed after the stop based on the difference between the aforementioned activation start time stored in the storage region of the activation start time calculation circuit 52 and the aforementioned plant stop time input to the user interface 51.

Procedure B3

Subsequently, the plant initial state calculation circuit 52 calculates a time required for the activation based on the calculated time elapsed after the stop. The time required for the activation is calculated based on the relationship (illustrated in FIG. 5) between the time elapsed after the stop and the time required for the activation, for example. The relationship between the time elapsed after the stop and the time required for the activation can be acquired from the activation control device 21 included in the activation schedule generation system 53. The relationship between the time elapsed after the stop and the time required for the activation may be stored as a table in the plant initial state calculation circuit 52.

Procedure B4

Subsequently, the plant initial state calculation circuit 52 calculates a start time of the activation by subtracting the time required for the activation, which is calculated in the procedure B3, from the target time input to the user interface 51, which represents the time when the activation of the plant is next completed. The start time of the activation is accumulated in the storage region (not illustrated) of the activation start time calculation circuit 52 again and updated as the start time of the latest activation.

Procedure B5

Subsequently, the plant initial state calculation circuit 52 determines whether or not the difference between the latest start time accumulated in the storage region, which represents the start time of the latest activation, and a start time (second latest start time) of the previous activation exceeds a specified time. If the difference exceeds the defined time, the procedures B2 to B4 are repeated. On the other hand, if the difference is less than the defined time, the calculation procedure proceeds to the procedure B6.

Procedure B6

The plant initial state calculation circuit 52 calculates an initial plant state amount such as the initial metal temperature based on the time elapsed after the stop and calculated in the procedure B2. The initial metal temperature is calculated based on a table of the time elapsed after the stop and the initial metal temperature, for example. The table is calculated based on plant characteristics such as the capacity of the metal of the steam turbine and the amount of heat released from air and is stored in the plant initial state calculation circuit 52.

The plant initial state amount calculated in the aforementioned procedure is input to the activation schedule generation system 53.

Figure 8:
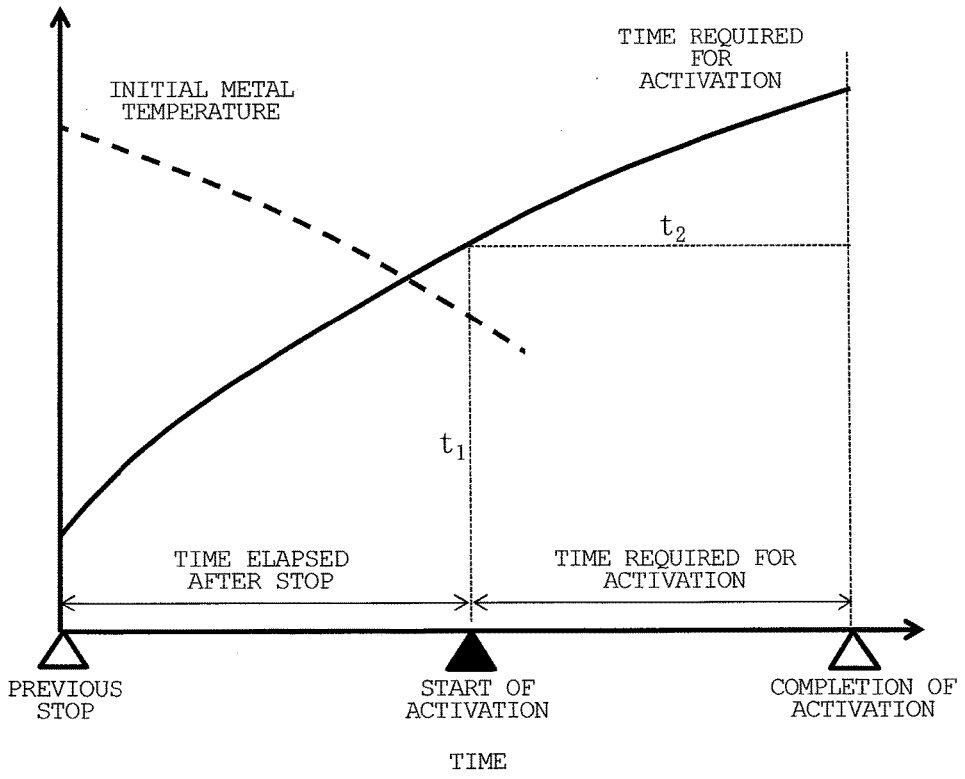
FIG. 8 is a diagram illustrating relationships between a completion time of the activation, a start time of the activation, a time elapsed after the stop, and a time required for the activation.

FIG. 8 is a diagram illustrating relationships between the completion time of the activation, the start time of the activation, the time elapsed after the stop, and the time required for the activation. In FIG. 8, a dotted line indicates transition of the initial metal temperature corresponding to the time elapsed after the stop. As the time elapsed after the stop increases, the initial metal temperature is reduced. In FIG. 8, a solid line indicates the time required for the activation corresponding to the time elapsed after the stop. As the initial metal temperature is reduced, the time required for the activation increases. The solid line illustrated in FIG. 8 is referred to as a required activation time increase function that receives the time elapsed after the stop and outputs the time required for the activation. Since the difference between a certain start time of the activation and a previous stop time is a time elapsed after the stop, a value $t_1$ obtained by substituting the time elapsed after the stop into the required activation time increase function is a time required for the activation. A value $t_2$ obtained by subtracting the time elapsed after the stop from a time period from the previous stop time to the completion time of the activation is also a time required for the activation. In the present embodiment, the aforementioned procedures B1 to B5 are described as the procedure for calculating a start time of the activation as an example. An arbitrary method may be used as long as a start time of the activation is calculated by the method based on the values $t_1$ and $t_2$ that are equal to each other.

3. Activation Schedule Generation System

The activation schedule generation system 53 generates the activation schedule using, as an input amount, the initial state amount of the plant as described in the second embodiment.

4. Output Device

The output device 54 displays details of the activation schedule generated by the activation schedule generation system 53. The details of the activation schedule are a time (or a start time of the activation) elapsed from the stop to the next activation, a time required for the activation, and the like. A method for outputting the details is not limited to the display output but may be another method such as audio output or printing output.

Effects

The effects described in the aforementioned embodiments and the following effects are obtained in the third embodiment.

In the present embodiment, when the operator specifies a next target completion time of the activation of the plant and the like, a time required for the activation is repeatedly calculated based on the table storing combinations of times elapsed after the stop and times required for the activation, which satisfy the target time. Thus, the time required for the activation and an activation time schedule corresponding to the time required for the activation can be acquired in advance. The activation time schedule that complies with a desired time in the power system can be generated.

In addition, in the present embodiment, the operator can confirm, based on the output of the output device 54, details of the activation time schedule generated by the activation schedule generation system 53. Thus, the operator can consider the appropriateness of an operation schedule while contemplating safety, efficiency, and the like.

Miscellaneous

It is to be noted that the present invention is not limited to the aforementioned embodiments, but covers various modifications. While, for illustrative purposes, those embodiments have been described specifically, the present invention is not necessarily limited to the specific forms disclosed. Thus, partial replacement is possible between the components of a certain embodiment and the components of another. Likewise, certain components can be added to or removed from the embodiments disclosed.

For example, the embodiments describe the case where the steam turbine plant 50 includes, as the adjusters, the heat source medium amount adjusting unit 11, the low-temperature fluid amount adjusting unit 12, the main steam adjusting valve 13, the bypass valve 14, and the desuperheater 15. However, the essential effect of the invention is the fact that the steam turbine plant 50 is activated at a high speed while the constraints are satisfied based on the various initial state amounts of the plant. Thus, not all the exemplified adjusters are required as long as the essential effect is obtained. For example, it is sufficient if at least one of the adjusters that is selected based on the state of the steam turbine plant 50 is arranged in the steam turbine plant 50.

In addition, the case where the operation amount of the steam turbine plant 50 and the state amount of the steam turbine plant 50 are input to the activation control device 21 is described as an example. The activation control device 21, however, may be configured so that either the operation amount of the plant or the state amount of the plant are input to the activation control device 21 as long as the essential effect is obtained.

In addition, the case where the predicting unit 22 includes the three constraint prediction calculation circuits 25 to 27 is described as an example. However, the predicting unit 22 is not limited to the aforementioned configuration as long as the essential effect is obtained. The constraint prediction calculation circuit of the predicting unit 22 depends on the number of the constraint to be considered. It is, therefore, sufficient if the predicting unit 22 includes at least one constraint prediction calculation circuit. The same applies to the requested operation amount calculation circuits (28 to 30).

The activation control device according to the invention is applicable to all plants each including a steam turbine such as a combined cycle power plant, a steam power plant, a solar power plant, and the like.

For example, if the activation control device according to the invention is applied to a combined cycle power plant, fuel gas such as natural gas or hydrogen may be used as the heat source medium, a fuel gas adjusting valve may be used as the heat source medium amount adjusting unit 11, air may be used as the low-temperature fluid, inlet guide vanes are used as the low-temperature fluid adjusting unit 12, a gas turbine may be used as the heat source device 1, gas turbine combustion gas may be used as the high-temperature fluid, and an exhaust heat recovery boiler may be used as the steam generator 2, in the configuration illustrated in FIG. 1.

In addition, if the activation control device according to the invention is applied to a steam power plant, coal or natural gas may be used as the heat source medium, a fuel adjusting valve may be used as the heat source medium amount adjusting unit 11, air or oxygen may be used as the low-temperature fluid, an air flow rate adjusting valve may be used as the low-temperature fluid amount adjusting unit 12, a furnace included in a boiler may be used as the heat source device 1, combustion gas may be used as the high-temperature fluid, and a heat transfer unit (steam generator) included in the boiler may be used as the steam generator 2, in the configuration illustrated in FIG. 1.

In addition, if the activation control device according to the invention is applied to a solar power plant, sunlight may be used as the heat source medium, a device for driving a heat collecting panel may be used as the heat source medium amount adjusting unit 11, a medium converting solar thermal energy and holding the converted energy such as oil, high-temperature solvent salt, or the like may be used as the low-temperature fluid and the high-temperature fluid, a flow rate adjusting valve for adjusting a flow rate of the oil, the high-temperature solvent salt, or the like may be used as the low-temperature fluid amount adjusting unit 12, the collecting panel may be used as the heat source device 1, equipment for heating supplied water to generate steam by thermal exchange with the high-temperature fluid may be used as the steam generator 2, in the configuration illustrated in FIG. 1.

In addition, if the activation control device according to the invention is applied to a power plant including a fuel battery and a steam turbine, fuel gas such as a carbon monoxide or hydrogen may be used as the heat source medium, a fuel gas adjusting valve may be used as the heat source medium amount adjusting unit 11, air may be used as the low-temperature fluid, an air adjusting valve may be used as the low-temperature fluid amount adjusting valve 12, the fuel battery may be used as the heat source device 1, fuel battery exhaust gas may be used as the high-temperature fluid, and an exhaust heat recovery boiler may be used as the steam generator 2, in the configuration illustrated in FIG. 1.

What is claimed is:

1. A power plant, comprising:

a heat source device configured to heat a low-temperature fluid using a heat source medium to generate a high-temperature fluid;

a steam generator for generating steam by thermal exchange with the high-temperature fluid;

a steam turbine to be driven by the steam;

an adjuster configured to operate to adjust a plant operation amount;

a first detector which measures the plant operation amount;

a second detector which measures a plant state amount; and a control device configured to:

input the plant operation amount measured by the first detector and input the plant state amount measured by the second detector, and calculate a predicted state amount of the plant based on the plant operation amount and the plant state amount and calculate a predicted value for at least one constraint to be used to control the activation of the steam turbine based on the predicted state amount of the plant, calculate, based on an initial state amount of the plant, which is calculated based on a measurement of the second detector, an activation control parameter, which is a coefficient included in a function to set an activation schedule for the heat source, to be used to control the activation of the steam turbine, calculate at least two requested operation amounts based on the predicted value for the at least one constraint and the activation control parameter, so that the constraint does not exceed a predetermined limit, select a minimum requested operation amount of the plant among the calculated at least two requested operation amounts, and calculate a deviation between the predicted state amount of the plant or temporal data of the predicted value of the at least one constraint and an actual state amount of the plant and correct the predicted state amount of the plant or the predicted value of the constraint based on the deviation, wherein the adjuster operates based on the minimum requested operation amount of the plant selected by the low value selector, thereby adjusting the plant operation amount.

2. The power plant according to claim 1, wherein the adjuster includes a heat source medium amount adjuster configured to adjust the amount of a heat source medium to be supplied to the heat source device and adjust the amount of heat held by the high-temperature fluid and includes a low-temperature fluid amount adjuster configured to adjust a flow rate of the low-temperature fluid and adjust a flow rate of the high-temperature fluid to be supplied from the heat source device to the steam generator.

3. The power plant according to claim 1, wherein the constraint includes at least one of a constraint for thermal stress and a constraint for a thermal elongation difference.

4. The power plant according to claim 3, wherein the constraint includes at least one of a constraint for thermal deformation of a casing and a constraint for a difference in temperature between the inside and outside of the casing.

5. The power plant according to claim 1, wherein the plant state amount includes a temperature of a predetermined member of the steam turbine and a time elapsed after the stop of the steam turbine and the initial value is a plant state amount before the activation of the steam turbine.

6. The power plant according to claim 1, wherein the predicted state amount of the plant includes a state amount of the steam that flows in the steam turbine or the metal temperature of the steam turbine.

7. The power plant according to claim 1, wherein the actual state amount includes the state amount of the plant or the constraint.

8. An activation schedule generation system comprising:

the power plant according to claim 1; and a plant state prediction circuit configured to simulate characteristics of the steam turbine plant, wherein the plant operation amount input to the plant state prediction circuit, and the plant state prediction circuit accumulates, in a storage region, the calculated state amount of the plant or temporal data of the constraint and temporal data of the plant operation amount for a time period from the start of the activation of the steam turbine plant to the completion of the activation.

9. An activation plan generation support system comprising:

a user interface configured to receive a target time when the activation of a plant is completed;

a plant initial state calculation circuit for calculating the initial state amount of the plant based on the target time received by the user interface;

the activation schedule generation system according to claim 8 that is configured to acquire the initial state amount of the plant calculated by the initial plant state calculation circuit, calculate a start time of the activation of the steam turbine plant and a time required for the activation, and generate an activation schedule; and an output device for outputting a relationship between the initial state amount of the plant calculated by the initial plant state calculation circuit and the time required for the activation, the time being calculated by the activation schedule generation system.

10. The activation plan generation support system according to claim 9, wherein the time required for the activation is expressed as a continuous function for the initial state amount of the plant.

11. The power plant according to claim 1, further comprising:

a power generator configured to convert driving force of the steam turbine into power.

* * * * *